US005309709A

United States Patent [19]

Cederwall et al.

[11] Patent Number: 5,309,709

[45] Date of Patent: May 10, 1994

[54] LOW EMISSION COMBUSTION SYSTEM FOR A GAS TURBINE ENGINE

[75] Inventors: Philip J. Cederwall; Kenneth O. Smith; Graham E. Ogborne, all of San Diego, Calif.

[73] Assignee: Solar Turbines Incorporated, San Diego, Calif.

[21] Appl. No.: 904,294

[22] Filed: Jun. 25, 1992

[51] Int. Cl.[5] ..... F23R 3/32

[52] U.S. Cl. ..... 60/39.23; 60/737; 60/742

[58] Field of Search ..... 60/39.23, 39.27, 39.29, 60/737, 739, 738, 740, 742, 748; 239/403, 405, 419, 419.3, 424.5, 432, 427.5, 533.3, 399

[56] References Cited

U.S. PATENT DOCUMENTS

| | | | |
|---|---|---|---|
| 2,655,787 | 10/1953 | Brown | 60/39.23 |
| 2,837,894 | 6/1958 | Kind | 60/39.27 |
| 2,954,172 | 9/1960 | Grundman . | |
| 3,285,007 | 11/1966 | Carlisle . | |
| 3,483,700 | 12/1969 | Ryberg . | |
| 3,684,186 | 8/1972 | Helmrich . | |
| 3,691,765 | 9/1972 | Carlisle . | |
| 3,728,859 | 4/1973 | Seiler | 60/39.49 |
| 3,866,413 | 1/1975 | Sturgess | 60/742 |
| 3,886,736 | 6/1975 | Kawaguchi | 60/39.74 |
| 3,906,718 | 9/1975 | Wood . | |
| 3,986,347 | 10/1976 | Schirmer | 60/39.29 |
| 4,054,028 | 10/1977 | Kawaguchi | 60/39.23 |
| 4,327,547 | 5/1982 | Hughes . | |
| 4,337,618 | 7/1982 | Hughes . | |
| 4,353,205 | 10/1982 | Cleary | 60/39.23 |
| 4,463,568 | 8/1984 | Willis . | |
| 4,470,262 | 9/1984 | Shekleton | 60/737 |
| 4,562,698 | 1/1986 | Halvorsen | 60/740 |
| 4,600,151 | 7/1986 | Bradley . | |
| 4,790,480 | 12/1988 | Rennie . | |
| 4,798,330 | 1/1989 | Mancini . | |
| 4,854,127 | 8/1989 | Vinson . | |
| 4,938,417 | 7/1990 | Halvorsen . | |
| 4,948,055 | 8/1990 | Belcher . | |
| 4,962,889 | 10/1990 | Halvorsen . | |
| 4,977,740 | 12/1990 | Madden . | |
| 4,999,996 | 3/1991 | Duchene . | |
| 5,014,918 | 5/1991 | Halvorsen . | |

FOREIGN PATENT DOCUMENTS

| | | | |
|---|---|---|---|
| 0122526B1 | 5/1987 | Sweden . | |
| 401868 | 11/1933 | United Kingdom | 60/39.23 |

*Primary Examiner*—Richard A. Bertsch
*Assistant Examiner*—Timothy S. Thorpe
*Attorney, Agent, or Firm*—Larry G. Cain

[57] ABSTRACT

The known control systems for reducing NOx in the combustion systems of past gas turbine engines has incorporated a variety of expensive and complicated techniques to reduce the NOx level. The present apparatus reduces the formation of NOx within the combustion zone by controlling the air portion of the air/fuel ratio. The present apparatus includes a device for controllably varying the quantity of compressed air directed into a manifold resulting in controlling the air to a plurality of injection nozzles and into a combustor. A throttling mechanism moves between an open position and a closed position varying the flow rate of compressor air to the combustor apparatus provides an economical, reliable and effective method for reducing and controlling the amount of nitrogen oxide (NOx) carbon monoxide (CO) and unburned hydrocarbon (UHC) emitted from the gas turbine engine.

26 Claims, 5 Drawing Sheets

LOW EMISSION COMBUSTION SYSTEM FOR A GAS TURBINE ENGINE

TECHNICAL FIELD

The present invention relates to a system for automatically maintaining gas turbine nitrogen oxide (NOx) emissions at a specific level in parts per million by volume during all ambient conditions for no load to full load operating parameters. More particularly, the invention relates to a system for controlling the combustible air directed to the injection nozzle to be mixed with the fuel to control the air to fuel ratio.

BACKGROUND ART

The use of fossil fuel as the combustible fuel in gas turbine engines results in the combustion products of carbon monoxide, carbon dioxide, water vapor, smoke and particulates, unburned hydrocarbons,, nitrogen oxide and sulfur oxides. Of these above produces, carbon dioxide and water vapor are considered normal and unobjectionable. In most applications, governmental imposed regulation have and are further restricting the amount of pollutants being emitted in the exhaust gases.

In the past the majority of the products of combustion have been controlled by design modifications. For example, smoke is normally controlled by design modifications in the combustor, particulates are normally controlled by traps and filters, and sulfur oxides are normally controlled by the selection of fuels being low in total sulfur. This leaves carbon monoxide, unburned hydrocarbons and nitrogen oxides as the emissions of primary concern in the exhaust gases being emitted from the gas turbine engine.

It is believed that such oxides are produced by the direct combination of atmospheric nitrogen and oxygen at the high temperatures occurring in the combustion zone. The presence of organic nitrogen in the fuel may also aid in the production of nitrogen oxides together with the atmospheric nitrogen. The rates with which nitrogen oxides form depend upon the flame temperature and, consequently, a small reduction in flame temperature will result in a large reduction in the nitrogen oxides.

Past and some present systems suggested means for reducing the maximum temperature in the combustion zone of a gas turbine combustor have included schemes for introducing more air at the combustion zone, recirculating cooled exhaust products into the combustion zone and injecting water spray into the combustion zone. An example of such a system is disclosed in U.S. Pat. No. 4,733,527 issued on Mar. 29, 1988 to Harry A. Kidd. The method and apparatus disclosed therein automatically maintains the NOx emissions at a substantially constant level during all ambient conditions and for no load to full load fuel flows. The water/fuel ratio is calculated for a substantially constant level of NOx emissions at the given operating conditions and, knowing the actual fuel flow to the gas turbine, a signal is generated representing the water metering valve position necessary to inject the proper water flow into the combustor to achieve the desired water/fuel ratio.

Another example of a method and apparatus for reducing NOx emissions is disclosed in U.S. Pat. No. 4,215,535 issued on Aug. 5, 1980 to George D. Lewis. In this patent, the apparatus has a combination of serpentine geometried, fuel-mixing tubes discharging to the radially outward area of the combustor and an axially oriented, fuel-mixing tube near the center of the combustor adapted to generate a strong centrifugal force field within the combustor. The tube near the center has a convergent section and a divergent section. A fuel supply means discharges fuel into the convergent section wherein vaporization is maintained by an axial velocity over the length of the tube. The force field promotes rapid mixing and combustion within the chamber to reduce both the magnitude of the combustor temperature and the period of exposure of the medium gases to that temperature, thus reducing the formation of NOx.

Another method for reducing the formation and emission of NOx is disclosed in U.S. Pat. No. 3,842,597 issued Oct. 22, 1974 to Frederic Franklin Ehrich. In this patent, a means for bleeding and cooling a portion of the airflow pressurized by the compressor is introduced into the primary combustion zone of the combustor in order to reduce the flame temperature effecting a reduction in the rate of formation of oxides of nitrogen.

The above systems are examples of attempts to reduce the emissions of oxides of nitrogen. Many of the attempts have resulted in additional expensive components. For example, the Kidd concept requires an additional means for injecting water into the combustion chamber which includes a water source, a control valve, a controlling and monitoring system and a device for injecting water into the combustion chamber. The Lewis concept requires a plurality of fuel-mixing tubes or injectors, a control system for each tube and a monitoring system with feedback to each of the controls of the individual tubes. The Ehrich concept requires additional components to bleed and cool a portion of the airflow pressured by the compressor and hardware to reintroducing the cooled air into the combustor.

Disclosure of the Invention

In one aspect of the invention a control system for reducing the formation of exhaust emissions during operation of a gas turbine engine is disclosed. The engine includes a source of compressed air, a combustor and a turbine arranged in serial order. The gas turbine engine further includes at least one fuel injection nozzle for directing a combustible fuel and compressed air into the combustor. The control system is comprised of a means for directing a portion of the flow of compressed air exiting the compressor section through the injection nozzle into the combustor in an amount sufficient, with the addition of an appropriate amount of fuel, to support full fuel operation of the gas turbine engine at rated speed. The control system is further comprised of a means for controllably varying the amount of air directed into the combustor by directing a portion of the air from the compressor section into the injection nozzle when the engine is operated at power levels between low fuel and high fuel conditions. The means for controllably varying is operative positioned between the source of compressed air and the combustor.

In another aspect of the invention a gas turbine engine includes a control system for reducing the formation of exhaust emissions during operation of a gas turbine engine. The engine includes a source of compressed air, a combustor and a turbine arranged in serial order. The gas turbine engine further includes at least one fuel injection nozzle directing a combustible fuel and compressed air into the combustor. The control system is comprised of a means for directing air from the source of compressed air through the injection nozzle into the combustor in an amount sufficient, with the addition of an appropriate amount of fuel, to support full fuel operation of the gas turbine engine at rated speed. The control system is further comprised of a means for controllably varying the amount of air directed into the combustor by directing a portion of the air from the compressor section into the injection nozzle when the engine is operated at power levels between low fuel and high fuel conditions. The means for controllably varying is operative positioned between the source of compressed air and the combustor.

In another aspect of the invention a combustor is comprised of an outer shell, an inner shell positioned inwardly of the outer shell, an inlet end connected to the outer and inner shells, an outlet end connected to the outer and inner shells, the inlet end having at least an opening therein. The combustor is further comprised of an injection nozzles being positioned within the opening, the injection nozzle has a main air passage positioned therein. The main air passage and a secondary air passage have a preestablished area through which a portion of the compressed air flows. During operation of the combustor the main air passage has a variable flow of air passing therethrough depending of the operating characteristics of the combustor. The combustor is further includes a source of fuel being connected with at least one of the main air passage and the secondary air passage.

BEST MODE FOR CARRYING OUT THE INVENTION

Figure 1:
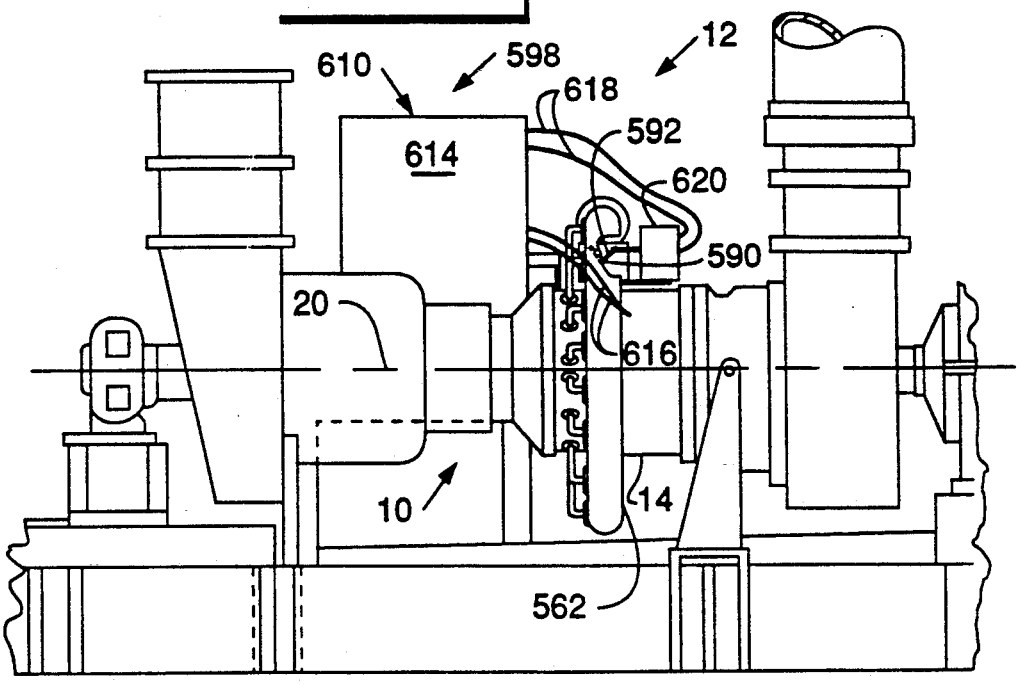
FIG. 1 is an external view of a gas turbine engine and control system having an embodiment of the present invention.
Figure 2:
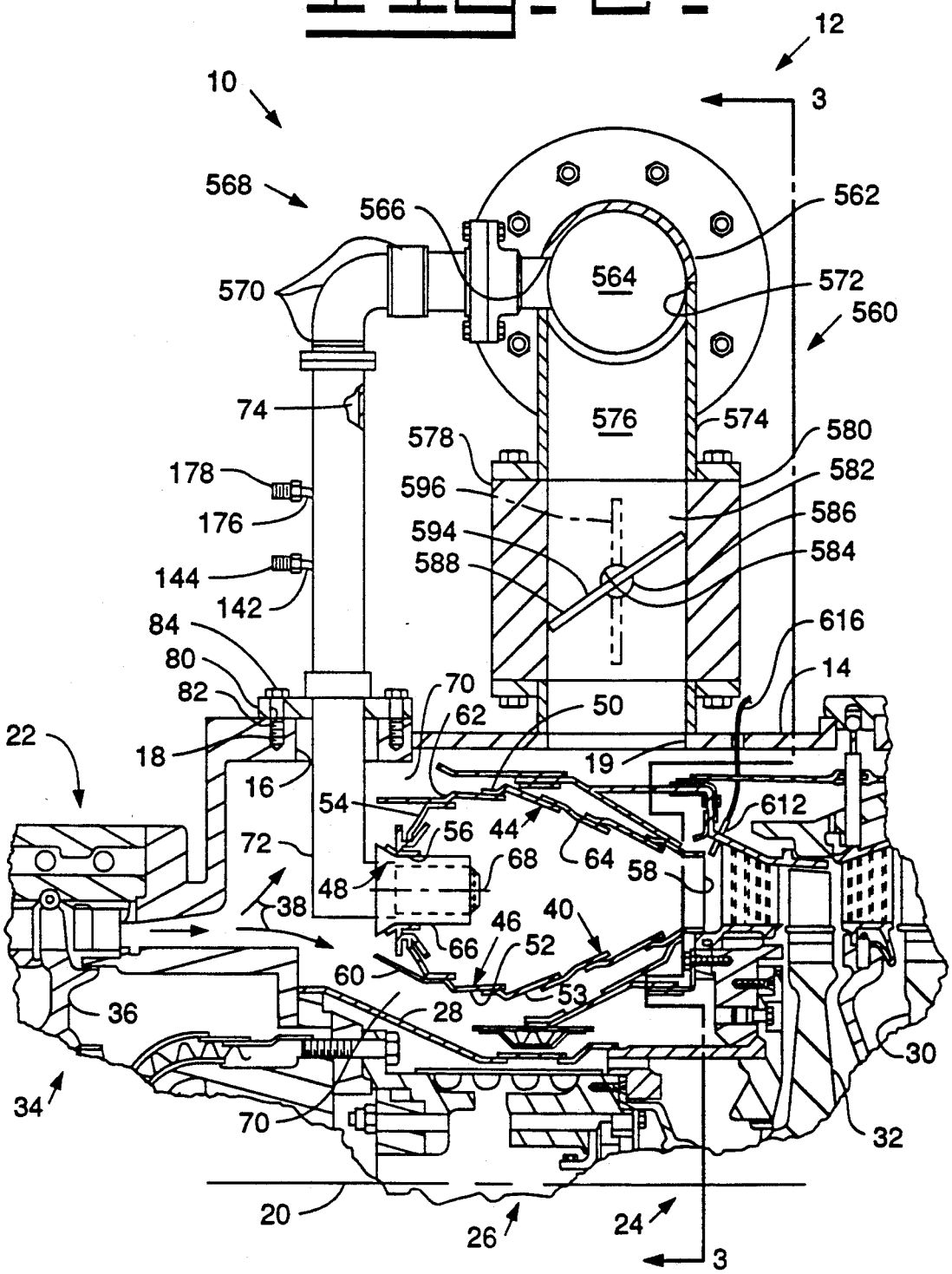
FIG. 2 is a partially sectioned side view of a gas turbine engine having an embodiment of the present invention.

In reference to FIG. 1 and 2, a gas turbine engine 10 having a control system 12 for reducing nitrous oxide emissions therefrom is shown. The gas turbine engine 10 has an outer housing 14 having therein a plurality of openings 16, of which only one is shown, having a preestablished position and relationship one to another. A plurality of threaded holes 18 are positioned relative to the plurality of openings 16. The housing 14 further includes at least a single aperture 19 therein and a central axis 20. The housing 14 is positioned about a compressor section 22 centered about the axis 20, a turbine section 24 centered about the axis 20 and a combustor section 26 positioned operatively between the compressor section 22 and the turbine section 24. The engine 10 has an inner case 28 coaxially aligned about the axis 20 and is disposed radially inwardly of the compressor section 22, turbine section 24 and the combustor section 26. The turbine section 24 includes a power turbine 30 having an output shaft, not shown, connected thereto for driving an accessory component such as a generator. Another portion of the turbine section 24 includes a gas producer turbine 32 connected in driving relationship to the compressor section 22. The compressor section 22, in this application, includes an axial staged compressor 34 having a plurality of rows of rotor assemblies 36, of which only one is shown. When the engine 10 is operating, the compressor 34 causes a flow of compressed air exiting therefrom designated by the arrows 38. As an alternative, the compressor section 22 could include a radial compressor or any source for producing compressed air. In this application, the combustor section 26 includes an annular combustor 40 being radially spaced a preestablished distance from the outer housing 14 and the inner case 28. The combustor 40 is supported from the inner case 28 in a conventional manner. The combustor 40 has a generally cylindrical outer shell 50 being coaxially positioned about the central axis 20, a generally cylindrical inner shell 52 having an outer surface 53 being coaxial with the outer shell 50, an inlet end 54 having a plurality of generally evenly spaced openings 56 therein and an outlet end 58. In this application, the combustor 40 is constructed of a plurality of generally conical segments 60. The outer shell 50 has an outer surface 62 and an inner surface 64 extending generally between the inlet end 54 and the outlet end 58. Each of the openings 56 has an injector 66 having a central axis 68 positioned therein, in the inlet end 54 of the combustor 40. The area between the outer housing 14 and the inner case 28 less the area of the combustor section 26 forms a preestablished flow or cooling area 70 through which the major portion of the compressed air 38 will flow. In this application, approximately 50 to 70 percent of the compressed air 38 is used for cooling. As an alternative to the annular combustor 40, a plurality of can type combustors could be incorporated without changing the gist of the invention.

Figure 4:
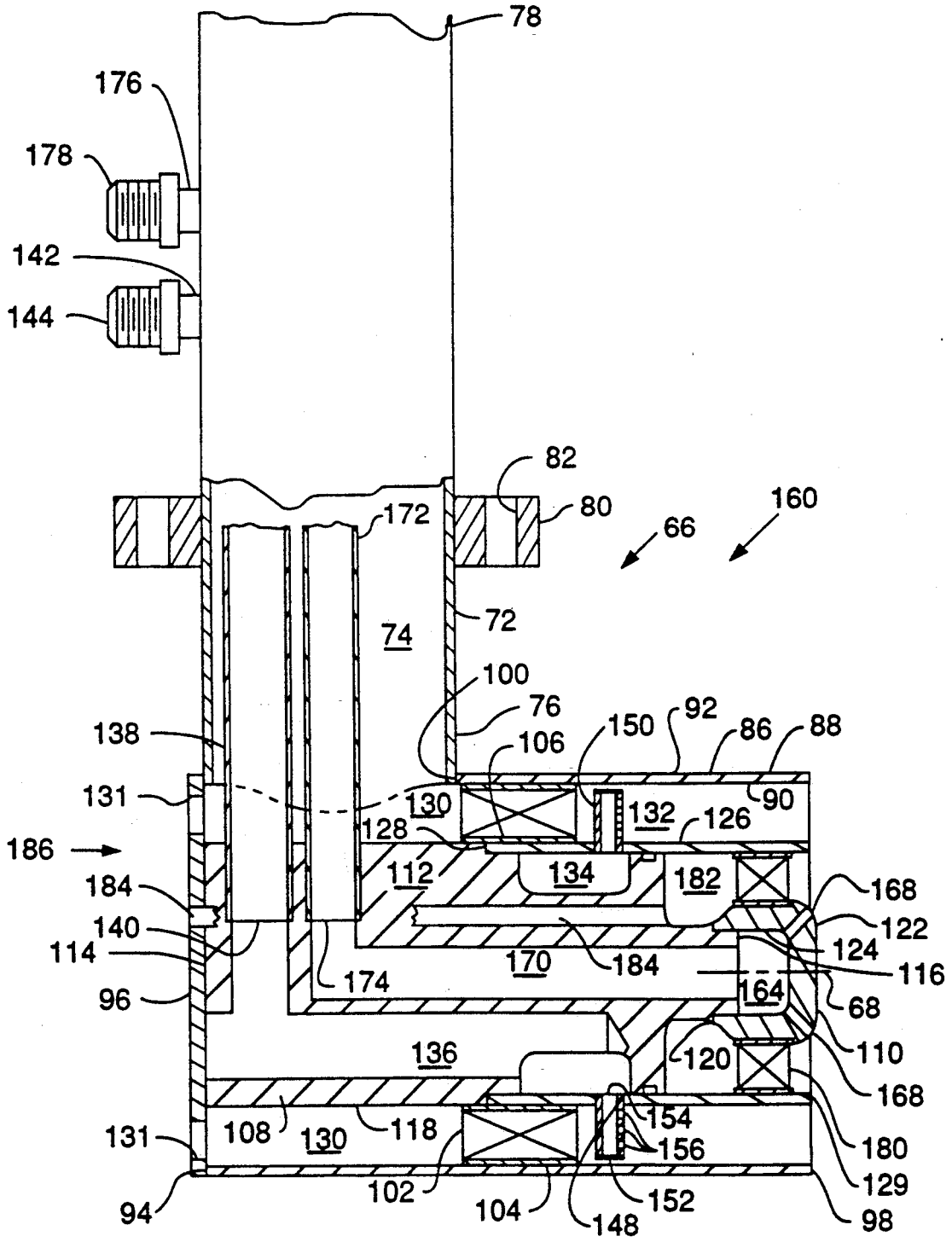
FIG. 4 is an enlarged sectional view of a dual fuel injector use in one embodiment of the present invention.

As best shown in FIG. 4, in this application each of the injectors 66 are of the single gaseous fuel type. Each of the injectors 66 is supported from the housing 14 in a conventional manner. For example, an outer tubular member 72 has a passage 74 therein. The tubular member 72 includes an inlet end portion 76 and an outlet end portion 78. The tubular member 72 extends radially through one of the plurality of openings 16 in the outer housing 14 and has a mounting flange 80 extending therefrom. The flange 80 has a plurality of holes 82 therein in which a plurality of bolts 84 threadedly attach to the threaded holes 18 in the outer housing 14. Thus, the injector 66 is removably attached to the outer housing 14. The injector 66 includes a generally cylindrical outer casing 86 having a wall 88 defining an inner surface 90 and an outer surface 92. The casing 86 is coaxially positioned about the central axis 68 and has a first end 94 closed by a plate 96 and a second open end 98. An aperture 100 defined in the wall 88 has the tubular member 72 fixedly attached therein. The aperture 100 is defined near the first end 94 and extends between the outer surface 92 and the inner surface 90. A plurality of swirlers 102 each have a preestablished length and shape, an outer portion 104-1 generally evenly positioned about the inner surface 90 of the casing 86 intermediate the aperture 100 and the second end 98 is attached to the inner surface 90. An inner portion 106 of each of the plurality of swirlers 102 is attached to an inner member 108 which is coaxially positioned about the central axis 68. The inner member 108 includes an end cap 110 and a main body 112 having a first end 114, a second end 116 and an external stepped surface 118 extending between the ends 114,116. The end cap 110 includes a first end 120, a second end 122 and a concave inner surface 124 extending from the first end 120 toward the second end 122. The first end 120 of the end cap 110 is attached to the main body 112 at the second end 116. The inner member 108 further includes a generally cylindrical shell 126 coaxially positioned about the central axis 68 and having a first end 128 and a second end 129. The first end 128 is attached to the external surface 118 intermediate the first and second ends 114,116 of the main body 112. The first end 114 of the main body 112 is also attached to the plate 96 or as an alternative may be integrally formed therewith. A first chamber 130 is defined by the end plate 96, a portion of the inner surface 90 of the casing 86, the plurality of swirlers 102 and a portion of the external surface 118 of the main body 112. A plurality of holes or passages 131 in the plate 96 communicate with the first chamber 130 and have a combined predetermined total area. In this application the predetermined total area of the plurality of holes 131 is equal to approximately 50 to 70 percent of the total maximum flow of compressed air passing through the injector nozzle 66. A second chamber or main air passage 132 is defined by the plurality of swirlers 102, a portion of the inner surface 90 of the casing 86, a portion of the shell 126 and the second open end 98 of the casing 86 and the second end 129 of the shell 126.

A first gaseous fuel gallery or annular groove 134 is defined intermediate the first and second ends 114,116 of the main body 112 and extends inwardly from the external surface 118 of the main body 112 a preestablished distance. A portion of the shell 126 is positioned over a portion of the external stepped surface 118 in sealing relationship and further defines the first annular groove 134. A main gas passage 136 communicates between the first annular groove 134 and the external surface 118 and exits near the first end 114 of the main body 112. A first gas tube 138 is at least partially positioned within the passage 74 of the tubular member 72 and has a first end portion 140 fixedly attached within the main gas passage 136 near the exit thereof at the external surface 118. A second end 142 of the first gas tube 138 sealingly exits the passage 74 through the wall of the tubular member 72 and has a threaded fitting 144 attached thereto for communicating with a source of gaseous combustible fuel, not shown. A plurality of holes 148 are radially spaced about the shell 126 and communicate between the first annular groove 134 and the second chamber 132. Positioned in each of the plurality of holes 148 is a hollow cylindrical spoke member 150 having a preestablished length, a first end 152 which is closed and a second end 154 which is open. The second end 154 of the spoke members 150 is positioned in each of the plurality of holes 148 and the spoke member 150 extends radially outward from the shell 126. The spoke member 150 has a plurality of passages 156 therein which are axially spaced along the cylinder. The plurality of passages 156 are positioned in such a manner so as to inject gaseous fuel in a predetermined manner into the second chamber 132 and the first closed end 152 is positioned radially inwardly from the inner surface 90 of the casing 86. The plurality of passages 156 are in fluid communication with the hollow portion of the cylindrical spoke member 150, the first annular groove 134 and the main gas passage 136. Thus, a means 160 for passing the main source of fuel through the injector 66 is formed. The means 160 for passing the main source of fuel includes the main air passage 132, the plurality of spoke members 150, the first annular groove 134, the main gas passage 136, the first gas tube 138 and the source of gaseous combustible fuel.

A pilot chamber 164 is defined by the concave surface 124 within the internal configuration of the end cap 110 of the inner member 108. The second end 122 of the end cap 110 has a plurality of exit passages 168, radially spaced thereabout, defined therein and in fluid communication with the pilot chamber 164. Each of the plurality of exit passages 168 is at an oblique angle to the central axis 68 of the injector nozzle 66. A pilot gas passage 170 communicates between the pilot chamber 164 and the external surface 118 of the main body 112 near the first end 114 of the main body 112. A second gas tube 172 is at least partially positioned within the passage 74 of the tubular member 72 and has a first end 174 fixedly attached within the pilot gas passage 170 near the exit thereof at the external surface 116. A second end 176 of the second gas tube 172 sealingly exits the passage 74 through the wall of the tubular member 72 and has a threaded fitting 178 attached thereto for communicating with a source of gaseous combustible fuel, not shown. The source of gaseous combustible fuels may be the same or an alternate sources from that supplied to the main gas passage 136.

A set of swirlers 180 each having a preestablished length and shape are generally evenly spaced and positioned inwardly about the shell 126 and outwardly from the end cap 110. The set of swirlers 180 are spaced a preestablished distance from a portion of the external stepped surface 118 and define a second fuel gallery or annular groove 182 between a portion of the external stepped surface 118, the shell 126 and the set of swirlers 180. A secondary passage 184 communicates between the second annular groove 182, the first end 114 of the main body 112 and further passes through the plate 96. The injector nozzle 66 further includes a means 186 for introducing secondary air into the injector nozzle 66. The means for introducing secondary air into the injector nozzle 66 includes the secondary passage 184 and the plurality of holes 131 in the plate 96.

Figure 5:
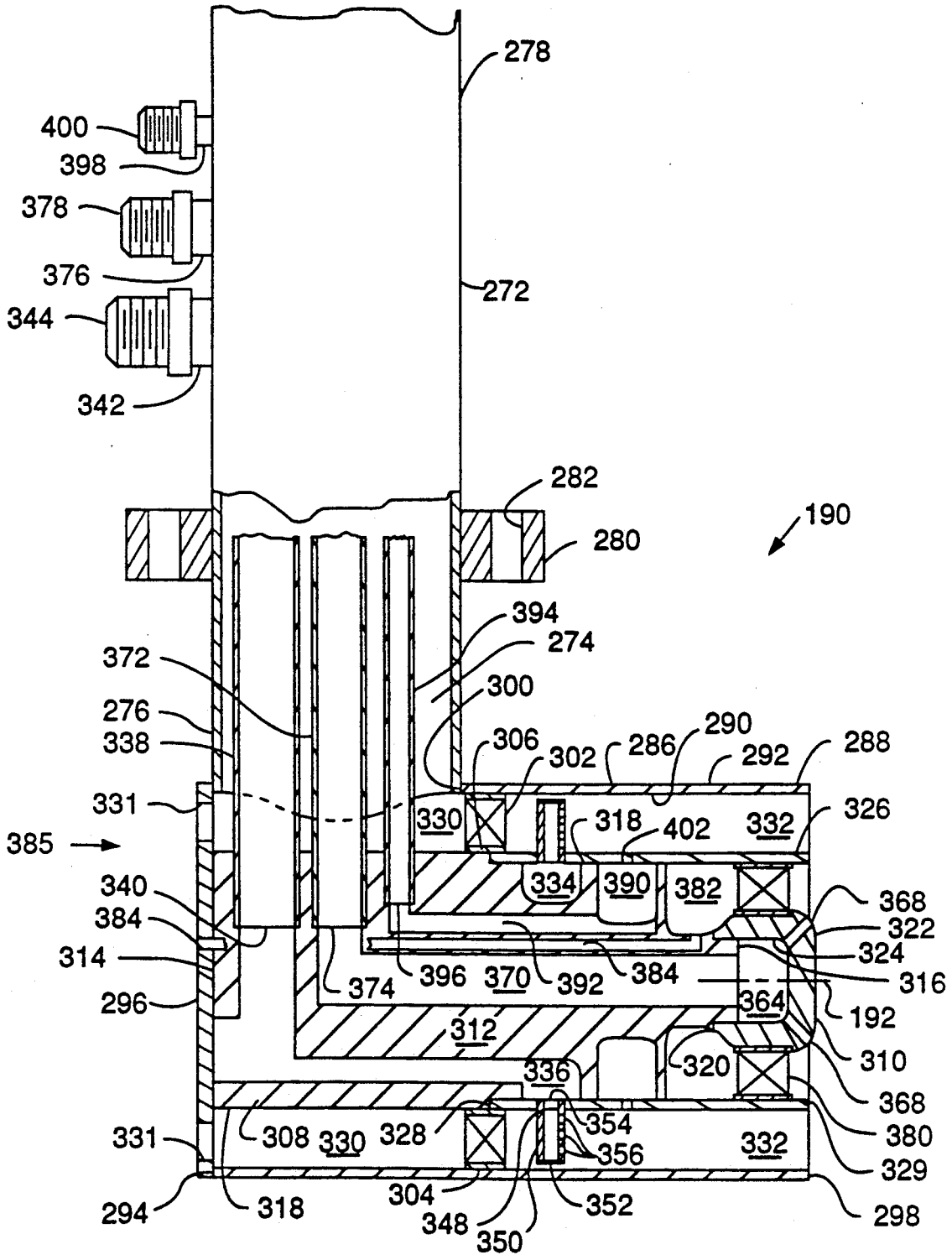
FIG. 5 is an enlarged sectional view of an alternate embodiment of a single fuel injector used in one embodiment of the present invention.

As an alternative, and best shown in FIG. 5, a dual fuel type injector 190, gaseous and liquid, can be used in place of the single gaseous fuel injector 66. Where applicable, the nomenclature used to identify the dual fuel type injector 190 is identical to that used to identify the single gaseous fuel type injector 66; however, the numbers are different. Each of the injectors 190 has a central axis 192 and is supported from the outer housing 14 in a conventional manner. For example, an outer tubular member 272 has a passage 274 therein. The tubular member 272 includes an inlet end portion 276 and an outlet end portion 278. The tubular member 272 extends radially through one of the plurality of openings 16 in the outer housing 14 and has a mounting flange 280 extending therefrom. The flange 280 has a plurality of hole 282 therein in which a plurality of bolts, not shown, threadedly attach to the threaded holes 18 in the outer housing 14. Thus, the injector 190 is removably attached to the outer housing 14. The injector 190 includes a generally cylindrical outer casing 286 having a wall 288 defining an inner surface 290 and an outer surface 292. The casing 286 is coaxially positioned about the central axis 192 and has a first end 294 which is closed by a plate 296 and a second open end 298. An aperture 300 defined in the wall 288 has the tubular member 272 fixedly attached therein. The aperture 300 is defined near the first end 294 and extends between the outer surface 292 and the inner surface 290. A plurality of swirlers 302 each have a preestablished length and shape, an outer portion 304 generally evenly spaced about the inner surface 290 of the casing 286 intermediate the aperture 300 and the second end 298 is attached to the inner surface 290. An inner portion 306 of each of the plurality of swirlers 302 is attached to an inner member 308 which is coaxially positioned about the central axis 192. The inner member 308 includes an end cap 310 and a main body 312 having a first end 314, a second end 316 and an external stepped surface 318. The end cap 310 includes a first end 320, a second end 322 and a concave inner surface 324 extending from the first end 320 toward the second end 322. The first end 320 of the end cap 310 is attached to the main body 312 near the second end 316. The inner member 308 further includes a generally cylindrical shell 326 which is coaxially positioned about the central axis 192 and has a first end 328 and a second end 329. The first end 328 is attached to the external surface 318 intermediate the first and second ends 314,316 of the main body 312. The first end 314 of the main body 312 is also attached to the plate 296 or as an alternative may be integrally formed therewith. A first chamber 330 is defined by the end plate 296, a portion of the inner surface 290 of the casing 286, the plurality of swirlers 302 and a portion of the external surface 318 of the main body 312. A plurality of holes or passages 331 in the plate 296 communicate with the first chamber 330 and have a combined predetermined total area. In this application the predetermined total area of the plurality of holes 331 is equal to approximately 50 to 75 percent of the total maximum flow of compressed air passing through the injector nozzle 190. A second chamber or main air passage 332 is defined by the plurality of swirlers 302, a portion of the inner surface 290 of the casing 286, a portion of the shell 326, the second open end 298 of the casing 286 and the second end 329 of the shell 326. A main gaseous fuel gallery or first annular groove 334 is defined intermediate the first and second ends 314,316 and extends inwardly from the external surface 318 of the main body 312 a preestablished distance. A portion of the shell 326 is positioned over a portion of the external stepped surface 318 in sealing relationship and further defines the first annular groove 334. A main gas passage 336 communicates between the first annular groove 334 and exits the external surface 318 near the first end 314 of the main body 312. A first gas tube 338 is at least partially positioned within the passage 274 of the tubular member 272 and has a first end portion 340 fixedly attached within the main gas passage 336 near the exit thereof at the external surface 318. A second end 342 of the first gas tube 338 sealingly exits the passage 274 through the wall of the tubular member 272 and has a threaded fitting 344 attached thereto for communicating with a source of gaseous combustible fuel, not shown. A plurality of holes 348 are defined within the shell 326, radially spaced about the shell 326 and communicate between the first annular groove 334 and the second chamber 332. Positioned in each of the plurality of holes 348 is a hollow cylindrical spoke member 350 having a preestablished length, a first end 352 which is closed and a second end 354 which is open. The second end 354 of the spoke member 350 is positioned in each of the plurality of holes 348 and the spoke member 350 extends radially outward from the shell 326. The spoke member 350 has a plurality of passages 356 therein which are axially spaced along the cylinder. The plurality of passages 356 are in fluid communication with the hollow portion of the cylindrical spoke member 350, the first annular ring 334 and the main gas passage 336. The plurality of passages 356 are positioned in such a manner so as to inject gaseous fuel in a predetermined manner into the second chamber 332 and the first closed end 352 is positioned radially inwardly from the inner surface 290 of the casing 286.

A pilot chamber 364 is defined by the concave surface 324 within the internal configuration of the end cap 310 of the inner member 308. The second end 322 of the end cap 310 has a plurality of exit passages 368 radially spaced thereabout, defined therein and in fluid communication with the pilot chamber 364. Each of the plurality of exit passages the injector nozzle 190. A pilot gas passage 370 communicates between the pilot chamber 364 and the external surface 318 of the main body 312 near the first end 314 of the main body 312. A second gas tube 372 is at least partially positioned within the passage 274 of the tubular member 272 and has a first end 374 fixedly attached within the pilot gas passage 370 near the exit thereof at the external surface 316. A second end 376 of the second gas tube 372 sealingly exits the passage 274 through the wall of the tubular member 272 and has a threaded fitting 378 attached thereto for communicating with a source of gaseous combustible fuel, not shown. The source of gaseous combustible fuels may be the same as the source supplied to the main gas passage 336 or an alternate sources. A set of swirlers 380 each having a preestablished length and shape are generally evenly spaced and positioned inwardly about the shell 326 and outwardly from the end cap 310. The set of swirlers 380 are spaced a preestablished distance from a portion of the external stepped surface 318 and define a second annular groove 382 between the external stepped surface 318, the shell 326 and the set of swirlers 380. A secondary passage 384 communicates between the second annular groove 382, the first end 314 of the main body 312 and further passes through the plate 296. The injector nozzle 190 further includes a means 385 for introducing secondary air into the injector nozzle 190. In this application, the means 385 for introducing secondary air into the injector nozzle 190 includes the secondary passage 384 and the plurality of holes 331 in the plate 296. A third fuel gallery or annular groove 390 is defined intermediate the first annular groove 334 and the second annular groove 382. The third annular groove 390 extends inwardly from the external surface 318 of the main body 312 a preestablished distance. A portion of the shell 326 is positioned over a portion of the external stepped surface 318 in sealing relationship and further defines the third annular groove 390. A liquid fuel passage 392 communicates between the third annular groove 390 and the external surface 318 and exits near the first end 314 of the main body 312. A liquid fuel tube 394 is at least partially positioned within the passage 274 of the tubular member 272 and has a first end portion 396 fixedly attached within the liquid fuel passage 392 near the exit thereof at the external surface 318. A second end 398 of the liquid fuel tube 394 sealingly exits the passage 274 through the wall of the tubular member 272 and has a threaded fitting 400 attached thereto for communicating with a source of liquid combustible fuel, not shown. A plurality of holes 402 are axially spaced between the plurality of holes 348 and the second end 329 of the shell 326. The plurality of holes 402 are generally evenly, circumferentially and radially spaced about the shell 326 and communicate between the third annular groove 390 and the second chamber 232.

Figure 6:
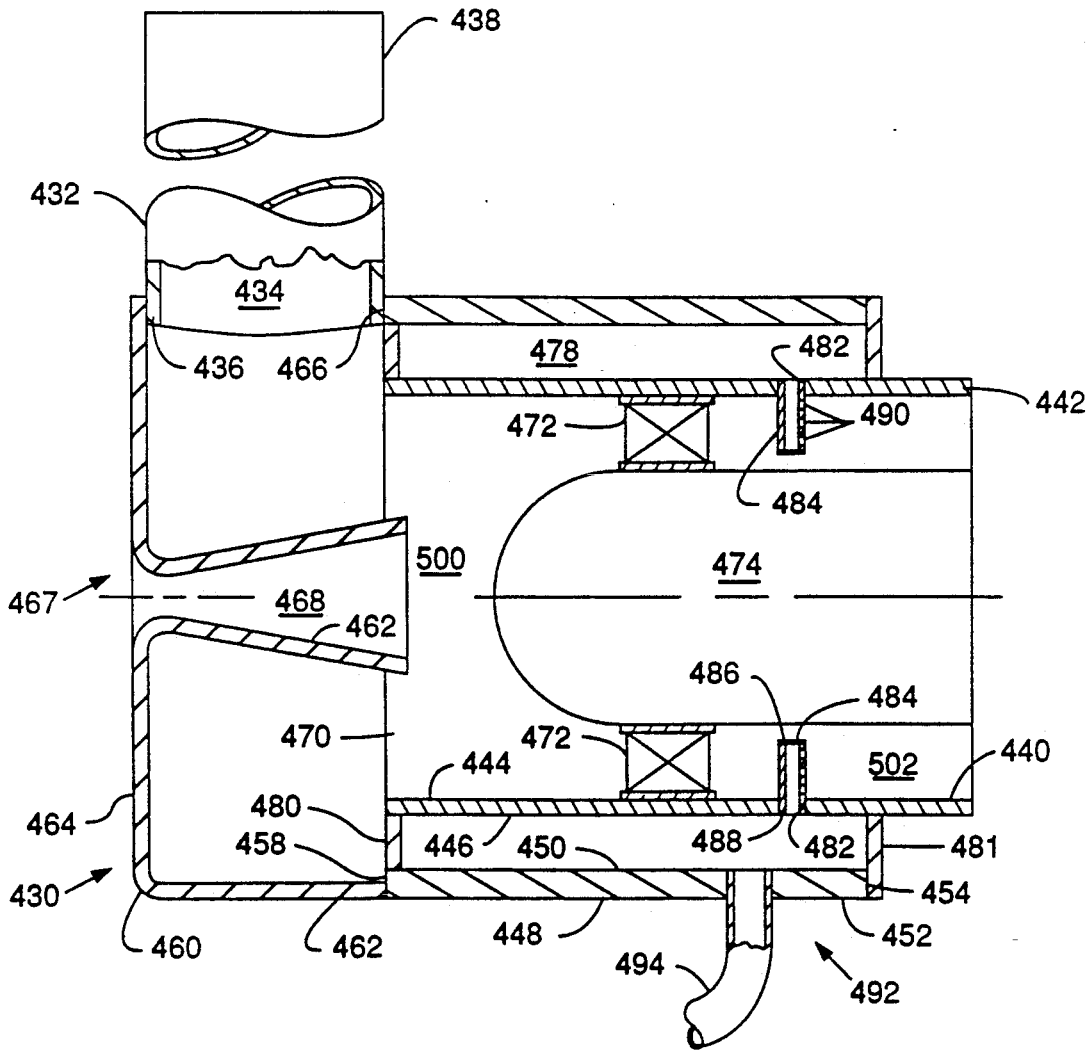
FIG. 6 is an enlarged sectional view of an alternate embodiment of a single fuel injector used in one embodiment of the present invention.

As best shown in FIG. 6, an alternate single fuel injection nozzle 430 is shown. This injection nozzle 430 includes an outer tubular member 432 having a passage 434 therein. The tubular member 432 extends radially through one of the plurality of openings 16 in the housing 14 and has a mounting flange, not shown extending therefrom. The flange has a plurality of holes therein to receive a plurality of bolts for threadedly attaching within the threaded holes 16 in the housing 14. Thus, the nozzle 430 is removably attached to the housing 14. The tubular member 432 further includes an inlet end portion 436 and an outlet end portion 438. The nozzle 430 further includes a generally cylindrical casing 440 having a wall 442 defining an inner surface 444 and an outer surface 446, a shell 448 defining an inner surface 450 and an outer surface 452, a first end portion 454 and a second end portion 458. A channel shaped member 460 includes an inlet portion 462 extending from a base 464. The inlet portion 462 is attached to the shell 448 of the casing 440 near the second end portion 458 and has an aperture 466 defined therein. The inlet portion 462 defines a means 467 for introducing secondary air into the injector nozzle 430.

In this application, the means for introducing secondary air is an orifice or passage 468 positioned in the base 464, defined by the inlet portion 462 and centered about the axis of the injector nozzle 430. The orifice 468 has a preestablished area. The inlet portion 462 is positioned in spaced relationship to the inner surface 444 of the inner wall 442 of the casing 440 and forms an orifice or passage 470 therebetween having a preestablished area. The orifice 470 is formed between the casing 440 and the inlet portion 462. The inlet end portion 436 of the outer tube member 432 is coaxially aligned with the aperture 466 and is fixedly attached to the channel member 460. The tube passage 434 is in fluid communication with the orifice 470. A plurality of swirler vanes 472 having a preestablished length and shape are generally evenly spaced about the inner surface 444 of the inner wall 442 and have one end fixedly attached thereto. A deflector member 474 is radially, inwardly, coaxially positioned within the casing 440 and is fixedly attached to the other end of each of the plurality of swirler vanes 472. A fourth fuel gallery or annular ring 478 is formed externally of the casing 440. For example, the fourth annular ring 478 is defined by the outer surface 446 of the inner wall 442, a plate 480 positioned at the inlet end portion 458, the inner surface 450 of the outer wall 448 and a plate 481 positioned at the outlet end portion 454. Positioned in the inner wall 442 of the casing 440 intermediate the end 454,458 is a plurality of holes 482 extending radially between the inner surface 444 and the outer surface 446. Positioned in each of the plurality of holes 482 and extending radially inwardly from the inner surface 444 of the inner wall 442 is a plurality of hollow spoke members 484. Each of the spoke members 484 have a preestablished length, a first end 486 which is closed and a second end 488 which is open. The second end 488 is positioned in each of the plurality of holes 482. A plurality of passages 490 are axially spaced along each of the spoke members 484 and are in fluid communication with the hollow portion of each of the spoke members 484. The injection nozzle 430 further includes a means 492 for communicating between the source of fuel and the main fuel gallery 478. The means 492 for communicating includes a tube 494 being in fluid communication between the main fuel gallery 478 and the source of fuel. One end of the tube 494 is attached to the fourth annular ring 478 and the other end of the tube 494 sealing exits the housing 14 for communicating with a source of fuel.

The injection nozzle 430 further includes an air passage 500 having a preestablished total area. The passage 500 is formed radially inwardly of the inner surface 444 of the inner wall 442 of the main body 440 and extends axially intermediate the inlet end portion 458 and the outlet end portion 454. The deflector member 474 is positioned within the air passage 500 and restricts the amount of compressed air flowing therethrough and forms a second chamber or main air passage 502 having a preestablished area. The main air passage 502 is positioned between the inner surface 444 and the deflector member 474. In this application, approximately 50 to 75 percent of the total maximum flow of compressed air passing through the injector nozzle 430 enters into the preestablished area of the air passage 500. The flow of compressed air through the main air passage 502 into the combustor 40 is an amount sufficient, with the addition of an appropriate amount of fuel, to support full load operation of the gas turbine engine 10. The plurality of passages 490 are positioned in such a manner so as to inject fuel in a predetermined manner into the main air passage 502 and the first closed end 486 is positioned radially inwardly from the inner surface 444 of the inner wall 442. Furthermore, in this application the preestablished effective cross sectional area of the orifice 470, which is in fluid communication with the air passage 500, is equal to approximately 50 to 75 percent of the effective cross sectional area of the preestablished area between the main body 440 and the deflector member 474.

As best shown in FIGS. 1 and 2, the control system 12 for reducing nitrogen oxide, carbon monoxide and unburned hydrocarbon emissions from the gas turbine engine 10 includes a means 560 for directing a portion of the flow of compressed air exiting the compressor section 22 through the injection nozzles 66,190,430 into the inlet end 48 of the combustor 40. The means 560 for directing a portion of the flow of compressed air includes the outer housing 14 and the inner case 28 and the outer shell 44, the inlet end 48 and the inner shell 46 of the combustor section 26. The preestablished spaced relationship of the outer and inner shells 44,46 of the combustor 40 to the outer housing 14 and the inner case 28 which forms the preestablished flow area 70 between the combustor 40, and the outer housing 14 and the inner case 26 is also a part of the means 560 for directing.

Figure 3:
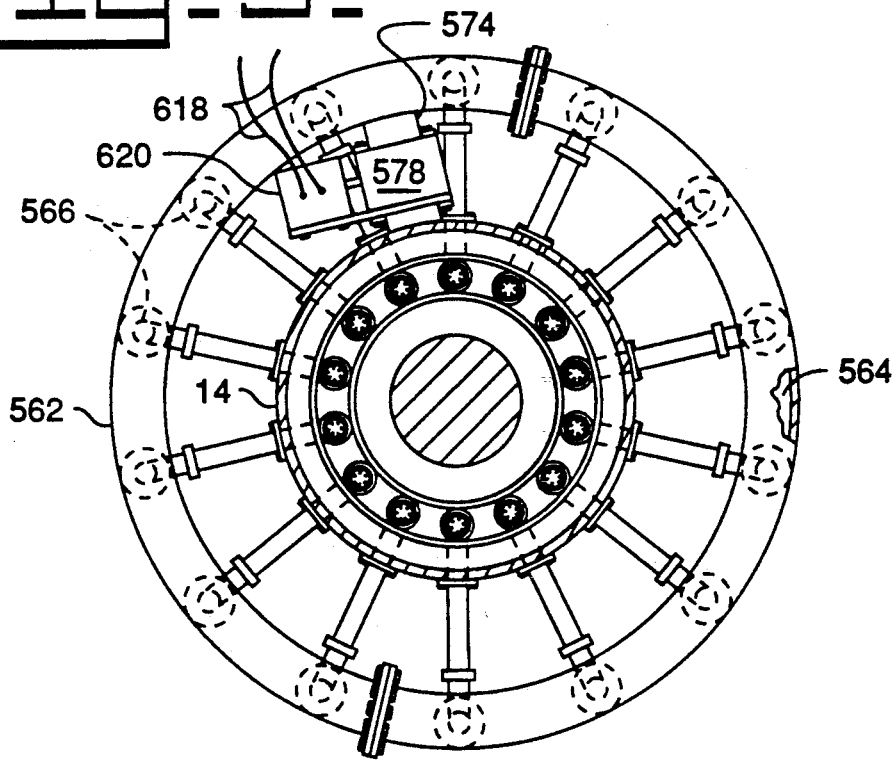
FIG. 3 is a partially sectioned end view taken through line 3—3 of FIG. 2.

As best shown in FIGS. 1, 2 and 3, the control system 12 for reducing nitrogen oxide, carbon monoxide and unburned hydrocarbon emissions from the engine 10 further includes a manifold 562 having a passage 564 therein. The manifold 562 is positioned externally of and encircles the outer housing 14. A plurality of openings 566 in the manifold correspond in location to the location of each of the tubular members 72,272,432. The tubular members 72,272,432 form a part of a means 568 for ducting and are attached in fluid communication with the plurality of openings 566 in the manifold 562. Thus, the tube passage 74,274,434 of the tubular member 72,272,432 is in fluid communication with the compressed air inside the passage 564 within the manifold 562. The means 568 for ducting includes a plurality of elbows, flanges and connectors 570. The manifold 562 further includes at least one primary inlet opening 572 having a duct 574 attached thereto. The duct 574 has a passage 576 defined therein which is in communicates with the passage 564 within the manifold 562 and the preestablished flow areas 70 between the combustor 40, and the outer housing 14 and the inner case 26 by way of the aperture 19 within the outer housing 14. Attached within the duct 574 is a valve 578. In this application, the valve 578 is of the conventional butterfly type but could be of any conventional design. The valve 578 includes a housing 580 having a passage 582 therein. Further included in the housing 580 is a through bore 584 and a pair of bearings, not shown, are secured in the bore 584. A shaft 586 is rotatably positioned within the bearings and has a throttling mechanism 588 attached thereto and positioned within the passage 582. The shaft 586 has a first end 590 extending externally of the housing 580. A lever 592 is attached to the first end 590 of the shaft 586 and movement of the lever 592 causes the throttling mechanism 588 to move between a closed position 594 and an open position 596.

Further included with the control system 12 for reducing nitrogen oxide, carbon monoxide and unburned hydrocarbon emissions is a means 598 for controllably varying the amount of air directed into the combustor 40. The means 598 for controllably varying is operatively positioned between the source of compressed air 22 and the combustor 40. In this application, the means 598 is positioned between the compressor 22 and the combustor 40. The air entering into the injection nozzle 66,190,430 is restricted or controlled at a minimum flow when the engine 10 is operating at lower power or fuel levels. The means 598 for varying the amount of air directed into the combustor 40 includes the following components. The first chamber 130,330 and the second chambers 132,332 having the preestablished area formed between the outer cylindrical casing 86,286 and the inner member 108,308 of each injector nozzle 66,190. The main air passage 502 having the preestablished area and formed between the main body 440 and the deflector member 474 and the orifice 470 having the preestablished area formed between the casing 440 and the inlet portion 462 of the injector nozzle 430. The passage 74,274,434 within the tubular member 72,284,432 and the passage 564 in the manifold 562 are also a part of the control system 12. The passage 576 within the duct 574 and the passage 582 in the housing 580. Furthermore, the throttling mechanism 588 within the passage 582 is included in the means 598 for controllably varying the amount of air directed into the combustor 40.

Further included with the control system 12 for reducing nitrogen oxide, carbon monoxide and unburned hydrocarbon emissions is a means 610 for monitoring and controlling the portion of the flow of compressed air controllably directed to the injection nozzle 66,190,430. The means 610 for monitoring and controlling includes a sensor 612 positioned within the engine 10 which monitors the power turbine 30 inlet temperature. As an alternative, many parameters of the engine such as load or speed could be used as the monitored parameter. The sensor 612 is connected to a control box or computer 614 by a plurality of wires 616 wherein a signal from the sensor 612 is interpreted and a second signal is sent through a plurality of wires 618 to a power cylinder 620. In this application, the power cylinder 620 is a hydroelectric cylinder, but as an alternative could be an electric solenoid or any other equivalent device. The power cylinder 620 moves the lever 592 and the corresponding throttling mechanism 588 between the open position 596 and the closed position 594. When the power turbine 30 inlet temperature reaches a preestablished temperature, which corresponds to a combustion temperature in the range of about 2700 to 3140 degrees Fahrenheit, the valve 578 having the throttling mechanism therein maintaining the amount of compressed air controllably directed to the injector 66,190,430. In this application, the movement of the throttling mechanism 588 is infinitely variable between the open position 596 and the closed position 594. However, as an option, the movement of the throttling mechanism 588 can be movable between the closed position 594 and the open position 596 through a plurality of preestablished stepped positions.

Although not shown, an alternative to a single duct 574 and a single valve 578 having a throttling mechanism 588 therein, could include a plurality of ducts 574 interconnecting the preestablished flow area 70 with the passage 564 within the manifold 562 without changing the gist of the invention. For example, if each of the plurality of ducts 574 have the valve 578 and the throttling mechanism 588 therein, a means for interconnecting the valves 578 will be required. One alternative for the means for interconnecting could include a plurality of the power cylinders 620 each having a common activation system which would insure that the position of each throttling mechanism 588 is simultaneously uniformly activated or controlled. Another alternative for the means for interconnecting could include a plurality of levers interconnecting each of the throttling mechanism 588 of each valve 578. One of the plurality of levers would have the power cylinder 620 attached thereto and would simultaneously uniformly activate the throttling mechanism 588. Another option could include a pair of the valves 578 being connected by a lever. Each of the levers would have the power cylinder connected thereto and would simultaneously uniformly activate the throttling mechanism 588 of each valve 578. Each of the pair of valves 578 would require a power cylinder 620 to activate the valve 578. The power cylinders would have a common activation system so that the position of each throttling mechanism 588 is uniformly activated or controlled.

Industrial Applicability

In use the gas turbine engine 10 is started and allowed to warm up and is used to produce either electrical power, pump gas, turn a mechanical drive unit or another application. As the demand for load or power produced by the generator is increased, the load on the engine 10 is increased and the control system 12 for reducing nitrogen oxide, carbon monoxide and unburned hydrocarbon emission is activated. In the start-up and warm-up condition, the throttling mechanism 588 of the valve 578 is positioned in either the partly open 596 or closed 594 position and the minimum amount of compressed air is directed into the injection nozzle 66,190,430 and the minimum amount of compressed air enters the combustor 40. During the start-up and warm-up condition the engine is in a high emissions mode and uses primarily pilot only fuel. For example, the majority of the compressed air from the compressor section 22 flows between the outer housing 14 and the inner case 28 into the preestablished flow or cooling area 70 formed between the outer housing 14 and the inner case 28 less the area of the combustor section 26. A small portion of the compressed air from the compressor section 22 flows through the secondary passage 184,384,468 into the second annular groove 182,382 or the air passage 500 and exits through the passages 186,368,502 into the combustor 40. When pilot fuel is being used, fuel enters through the second gas tube 172,372,494 travels along the pilot gas passage 170,370,479 into the pilot chamber 164,364,502. From the pilot chamber 164, the pilot fuel exits through the plurality of exit passages 168,368 and intermixes with the small portion of compressed air entering through the secondary passage 184,384,468 in the injector nozzle 66,190,430. An additional small portion of the compressor air also enters through the plurality of holes 131,331 in the end plate 96,296, communicates with the first chamber 130,330,500 passes through the plurality of swirlers 102,302,472 into the second chamber 132,332,502 and exits into the combustor 40. Furthermore, within the combustor 40, the air which has entered through the plurality of holes 131,331,468 further mixes with the pilot fuel and air mixture and is burned during the high emissions mode. In this mode the remainder of the air from the compressor flows through the preestablished flow area 70.

With the throttling mechanism 588 in the fully open position 596, the maximum allowable flow of compressed air is drawn from the preestablished flow area 70 and is directed through the openings 19 in the outer housing 14 into the passage 576 within the duct 574 through the valve 578 and into the passage 564 within the manifold 562. From the passage 564, the air is communicated into the tube passages 74,274,434 within the tubular members 72,272,432 and into the injector nozzles 66,190,430.

In the single gaseous fuel type injector nozzle 66,430 and the dual fuel type injector nozzle 190, the position of the throttling mechanism 588 intermediate the closed position 594 and the open position 596 determines the amount of primary air from the compressor section 22 that is to be mixed with fuel within the injector nozzle 66,190,430. Thus, the fuel/air ratio and the temperature within the combustor 40 is controlled and the formation of nitrogen oxide, carbon monoxide and unburned hydrocarbon is minimized. As the load on the engine 10 is increased, the amount of fuel injected into the combustor section 26 is increased, the fuel/air ratio changes and the combustion temperature within the combustor section 26 is increased. The results of the increase of combustion temperatures causes the temperature of the gases at the power turbine 30 inlet to increase. The sensor 612 sends a signal through the plurality of wires 616 to the computer 614 which is interpreted to indicated an increase in the power turbine 30 inlet temperature and a second signal is sent through the plurality of wires 618 to the power cylinder 620 causing the lever 592 and throttling mechanism 588 to move toward the open position 596. This increases the amount of air directed into the injector nozzle and increases the amount of air directed to the combustor 40. The continued monitoring by the sensor 612 and interpretation by the computer 614 keeps the air/fuel ratio relatively constant. In order to accelerate, the air/fuel ratio must change. For example, in the air/fuel ratio, the relationship of the amount of fuel increases whereas the air remains constant. However, the control system 12 is adapted to control the temperature of combustion and the potential resulting increased emissions of nitrogen oxide, carbon monoxide and unburned hydrocarbon during combustion temperatures of generally between about 2700 to 3140 degrees Fahrenheit. The temperature of the gases entering into the turbine section 24 is monitored constantly and if the temperature reaches the range of between about 2700 to 3140 degrees Fahrenheit the temperature remains at this high temperature for only a short period of time. Thus, the emissions are controlled by the variation or change in air/fuel ratio resulting in high combustion temperatures. As the engine 10 accelerates, the fully open position 596 is reached wherein the valve 578 has the lever 592 and throttling mechanism 588 fully opened increasing the flow of air through the passage 576 drawing a greater percentage of compressor air from the flow passage 70. Thus, the flow of compressed air through the the second chamber 132,332 and the orifice 470 is increased.

Other aspects, objectives and advantages of this invention can be obtained from a study of the drawings, the disclosure and the appended claims.

We claim:

1. A control system for reducing the formation of exhaust emissions during operation of a gas turbine engine, the engine including a source of compressed air, a combustor and a turbine arranged in serial order, a plurality of fuel injection nozzles for directing a combustible fuel and compressed air into the combustor, each fuel injection nozzle having a chamber therein in which air and fuel is premixed prior to entering into the combustor; said control system comprising:

means for directing a portion of the flow of compressed air exiting the compressor section through the plurality of injection nozzles into the combustor in an amount sufficient, with the addition of an appropriate amount of fuel, to support full fuel operation of the gas turbine engine at rated speed, said means for directing including a manifold encircling the gas turbine and positioned externally thereof, said manifold being in communication with the flow of compressed air exiting the compressor section by way of a duct positioned between the manifold and the gas turbine engine, each of said plurality of injection nozzles being in communication with the manifold;

means for controllably varying the amount of air directed into the combustor by directing a portion of the air from the compressor section into the manifold and into each of the plurality of injection nozzles when the engine is operated at power levels between low fuel and high fuel conditions, said means for controllably varying being operatively positioned within the duct between the source of compressed air and the manifold.

2. The control system for reducing exhaust emissions from a gas turbine engine of claim 1 wherein said means for controllably varying the amount of air directed into the combustor includes a throttling mechanism positioned within the duct.

3. The control system for reducing exhaust emissions from a gas turbine engine of claim 2 wherein said plurality of injection nozzles includes means for introducing secondary air through each of the injection nozzles into the combustor.

4. The control system for reducing exhaust emissions from a gas turbine engine of claim 3 wherein said means for introducing secondary air into the combustor includes a secondary passage having a preestablished area.

5. The control system for reducing exhaust emissions from a gas turbine engine of claim 4 wherein said preestablished area of the secondary passage is sized allowing about 5 percent of the total maximum flow of compressed air passing through each of the injector nozzles to enter into the combustor.

6. The control system for reducing exhaust emissions from a gas turbine engine of claim 2 wherein said throttling mechanism includes a butterfly type valve.

7. The control system for reducing exhaust emissions from a gas turbine engine of claim 6 wherein said throttling mechanism includes a housing and a control lever positioned externally of the housing.

8. The control system for reducing exhaust emissions from a gas turbine engine of claim 7 wherein said throttling mechanism being movable between a closed position and an open position, and said throttling mechanism being infinitely variable between the open position and the closed position.

9. The control system for reducing exhaust emissions from a gas turbine engine of claim 7 wherein said throttling mechanism being movable between an open position and a closed position through a plurality of preestablished stepped positions.

10. The control system for reducing exhaust emissions from a gas turbine engine of claim 1 wherein said means for directing air from the source of compressed air through the injection nozzle into the combustor includes the combustor positioned within the outer housing and a preestablished cooling area formed between the outer housing and the inner case less the area of the combustor.

11. The control system for reducing exhaust emissions from a gas turbine engine of claim 10 wherein said preestablished cooling area within the housing allows between 50 to 75 percent of the compressed air to flow therethrough.

12. The control system for reducing exhaust emissions from a gas turbine engine of claim 11 wherein said combustor includes an outer shell and an inner shell each of said outer and inner shells having an outer surface respectively in which the air flowing through the preestablished cooling area passes thereover and cools the combustor.

13. A gas turbine engine having a control system for reducing the formation of exhaust emissions during operation of a gas turbine engine, the engine including a source of compressed air, a combustor and a turbine arranged in serial order, a plurality of fuel injection nozzles directing a combustible fuel and compressed air into the combustor, each of said plurality of fuel injection nozzles having a chamber therein in which air and fuel is premixed prior to entering into the combustor; said control system comprising:

means for directing air from the source of compressed air through the plurality of injection nozzles into the combustor in an amount sufficient, with the addition of an appropriate amount of fuel, to support full fuel operation of the gas turbine engine at rated speed, said means for directing including a manifold encircling the gas turbine, air exiting the compressor section by way of a duct positioned between the manifold and the gas turbine engine, each of said plurality of injection nozzles being in communication with the manifold;

means for controllably varying the amount of air directed into the combustor by directing a portion of the air from the compressor section into the manifold and into each of the plurality of injection nozzles when the engine is operated at power levels between low fuel and high fuel conditions, said means for controllably varying being operatively positioned between the source of compressed air and the manifold.

14. The gas turbine engine of claim 13 wherein said means for controllably varying the amount of air directed into the combustor includes a throttling mechanism positioned within the duct.

15. The gas turbine engine of claim 14 wherein said plurality of injection nozzles includes means for introducing secondary air through each of the injection nozzles into the combustor.

16. The gas turbine engine of claim 15 wherein said means for introducing secondary air into the combustor includes a secondary passage having a preestablished area.

17. The gas turbine engine of claim 16 wherein said preestablished area of the secondary passage is sized allowing about 5 percent of the total maximum flow of compressed air passing through each of the injector nozzles to enter into the combustor.

18. The gas turbine engine of claim 14 wherein said throttling mechanism includes a valve connected between the source of compressed air and the injection nozzle.

19. The gas turbine engine of claim 18 wherein said throttling mechanism includes a butterfly type valve.

20. The gas turbine engine of claim 18 wherein said throttling mechanism includes a housing and a lever positioned externally of the housing.

21. The gas turbine engine of claim 18 wherein said throttling mechanism being movable between an open position and a closed position, and said throttling mechanism being infinitely variable between the open position and the closed position.

22. The gas turbine engine of claim 18 wherein said throttling mechanism being movable between an open position and a closed position through a plurality of preestablished stepped positions.

23. The gas turbine engine of claim 13 wherein said preestablished cooling area allows between 50 to 75 percent of the compressed air to flow therethrough.

24. The gas turbine engine of claim 23 wherein said combustor includes an outer shell and an inner shell each having an outer surface respectively having air flowing through the preestablished cooling area passes along the outer surfaces and cools the combustor.

25. The gas turbine engine of claim 13 wherein said means for controllably varying the amount of air directed into the combustor includes a manifold having a passage therein and encircling the outer housing, said manifold having a inlet opening therein and a valve being connected to the inlet opening and to the manifold, said injection nozzles having a main air passage through which the increased flow of air passes prior to entering into the combustor and a secondary air passage with a preestablished area through which a portion of the compressed air can enter.

26. The gas turbine engine of claim 25 wherein said throttling mechanism being movable between an open position and a closed position and said position between the open position and the closed position being dependent on the operating parameters of the gas turbine engine.

* * * * *

UNITED STATES PATENT AND TRADEMARK OFFICE

CERTIFICATE OF CORRECTION

PATENT NO. : 5,309,709

DATED : May 10, 1994

INVENTOR(S) : Philip J. Cederwall et al

It is certified that error appears in the above-indentified patent and that said Letters Patent is hereby corrected as shown below:

On the title page, item [54] and column 1, lines 2 and 3, correct the title to read --APPARATUS FOR VARYING COMBUSTION AIR TO A COMBUSTOR--.

Signed and Sealed this

Fourth Day of October, 1994

*Attest:*

*Attesting Officer*

Bruce Lehman

BRUCE LEHMAN

*Commissioner of Patents and Trademarks*